United States Patent [19]

Mbuthia

[11] Patent Number: 4,949,077

[45] Date of Patent: Aug. 14, 1990

[54] PORTABLE UNIT WITH SMOKE ALARM, CLOCK RADIO, COMPASS, RETRACTABLE TABLE, AND LAMP

[76] Inventor: David G. Mbuthia, 188 Lower Sheep Pasture Rd., East Setauket, N.Y. 11733

[21] Appl. No.: 415,630

[22] Filed: Oct. 2, 1989

[51] Int. Cl.[5] ..... G08B 17/10

[52] U.S. Cl. ..... 340/628; 340/691; 340/693; 368/11; 362/253

[58] Field of Search ..... 340/628-630, 340/691, 693; 362/33,133, 97-99, 253; 368/11; 312/233, 237

[56] References Cited

U.S. PATENT DOCUMENTS

| | | | |
|---|---|---|---|
| 3,368,067 | 2/1968 | Paxinos | 362/253 |
| 3,736,742 | 6/1973 | Mabuchi, et al. | 368/10 |
| 3,884,538 | 5/1975 | Wise | 312/233 |
| 4,045,663 | 8/1977 | Young | 455/344 |
| 4,178,592 | 12/1979 | McKee | 340/628 |
| 4,186,389 | 1/1980 | Flittie | 340/628 |
| 4,396,941 | 8/1983 | Nishimura et al. | 455/344 |
| 4,419,658 | 12/1983 | Jarosz et al. | 340/628 |
| 4,419,770 | 12/1983 | Yagi et al. | 368/10 |
| 4,438,428 | 3/1984 | Ober et al. | 340/628 |
| 4,570,155 | 2/1986 | Skarman et al. | 340/628 |
| 4,611,200 | 9/1986 | Stilwell | 340/628 |
| 4,617,561 | 10/1986 | Brown | 340/628 |
| 4,668,100 | 5/1987 | Murakami et al. | 368/10 |
| 4,676,619 | 6/1987 | Wooley | 455/344 |
| 4,716,402 | 12/1987 | Francis | 340/693 |
| 4,796,015 | 1/1989 | Admire, Jr. | 340/628 |

*Primary Examiner*—Joseph A. Orsino
*Assistant Examiner*—Jill Jackson
*Attorney, Agent, or Firm*—Hopgood, Calimafde, Kalil, Blaustein & Judlowe

[57] ABSTRACT

A personal security device is disclosed which includes, in combination, a smoke detection and smoke alarm system, a radio, a digital time clock, a compass, a high intensity lamp, and a retractable writing table. The writing table is disposed below the lamp beam to facilitate use of the table in a darkened area.

10 Claims, 1 Drawing Sheet

PORTABLE UNIT WITH SMOKE ALARM, CLOCK RADIO, COMPASS, RETRACTABLE TABLE, AND LAMP

BACKGROUND OF THE INVENTION

The present invention generally relates to portable security devices. More specifically, the present invention relates to portable personal-security devices having various components disposed within a unitary structure.

Personal security devices are useful for primary or supplemental protection of the occupants of hotels, nursing homes, college dormitories, campsites, private homes, mobile homes and the like. Such devices are particularly important in countries where smoke and fire-detection equipment is either not mandatory, or enforcement of the fire-protection laws is routinely neglected. Various personal-security devices are disclosed in the prior art having modular components and various components arranged in combination within a singular housing. In U.S. Pat. No. 4,716,402 to Francis, a personal-security device having modular components is disclosed which provides means for various assembly configurations and combinations. The device of the Francis disclosure includes smoke detector, motion detector, chemical spray, main alarm and mounting modules; the main alarm module may be separately carried on the person of the user or mounted in connection with the other modules to the mounting module for attachment to a door or wall. In U.S. Pat. No. 4,617,561 to Brown, a combination emergency light and smoke-alarm system is disclosed wherein a flashlight is removably mounted in a manner to permit automatic activation of the flashlight upon removal from its mounting bracket. In U.S. Pat. No. 4,419,658 to Jarosz et al., a portable protection device combines a high intensity lamp, smoke detector and power-failure alarm. Various other modular constructions and combinations are known in the prior art including U.S. Pat. No. 4,676,619 to Woolley, U.S. Pat. No. 4,396,941 to Nishimura et al., and U.S. Pat. No. 4,045,663 to Young. The above-cited prior art is not intended to be exhaustive but is, on the other hand, illustrative of the scope of the prior art.

BRIEF STATEMENT OF THE INVENTION

An object of the present invention is to provide a personal-security device which is not only portable and attractive in appearance but which also combines a number of features for personal safety and survival in a hostile or insecure environment.

A specific object of the present invention is to provide a portable security device that meets the above object and is detectable in the dark or in a smoke-filled area.

It is also an object to provide a portable security device which additionally provides a tabular surface for writing.

The personal security device of the invention meets these objects by providing, in combination within a compact, unitary housing, a smoke-detection and alarm system, a radio, a digital time clock, a compass, a high-intensity lamp, and a retractable writing table. The lamp is disposed within the housing in a manner permitting it to light the surface of the writing table, and the writing table is retractable within the body of the unitary housing. The unitary housing further includes an integrally constructed pencil holder disposed to one side of said housing, and a strap handle constructed of fire-resistant material disposed at one end of the housing. The lamp is electronically interconnected with the smoke-detection and alarm system for automatic lighting upon detection of smoke; alternatively, the lamp is selectively operable.

DETAILED DESCRIPTION

Figure 1:
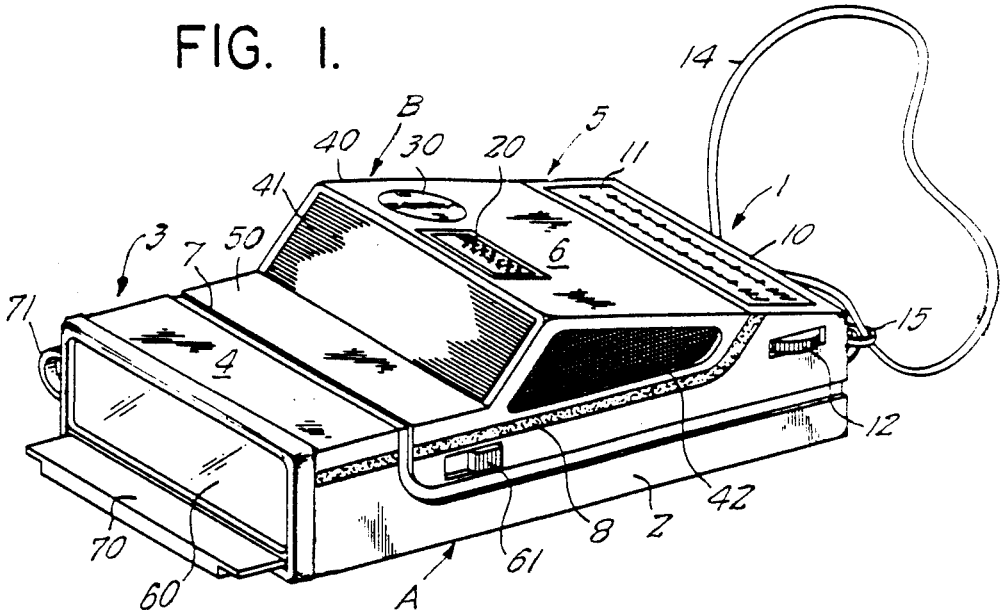
FIG. 1 is a front three-quarter perspective view of the presently preferred embodiment of the invention showing one end and one longitudinal side of the device.

FIG. 1 illustrates in perspective the presently preferred embodiment of a personal security device 1 of the invention. Device 1 includes a radio 10, a time clock 20, a compass 30, a smoke-detection and alarm system 40, a battery compartment 50, a high-intensity lamp 60, and a retractable writing table 70, disposed in combination within a unitary housing 2. Housing 2 is formed with a forepart 3 having a flat top surface 4, and a raised rearpart 5 has a sloped top surface 6, sloping downwardly in the front-to-rear direction. Radio 10 is disposed within the rear-edge portion of the rearpart 5 of housing 2 and extends for the width of said housing 2. Station indicia 11 of the radio are viewable at the sloping top surface 6 of housing 2, with the station-selection dial exposed for edge-driven actuation at the side wall of housing 2 and to one side of the radio 10; and a rotatable element 13 for on-off switching and volume control of the radio is similarly exposed at the opposite side wall of housing 2. Time clock 20 is disposed forwardly from said radio 10 on the sloped top surface 6 at the front edge of the rearpart 5. Preferably, time clock 20 has dual digital-time indicating means which are separately operable so that the time in two different zones can be maintained. Compass 30 is disposed next to time clock 20 on the sloped top surface 6 at the front edge of the rearpart 5. The smoke-detection and alarm system 40 is disposed within the body of the rearpart 5 of housing 2 below said time clock 20 and said compass 30. A screen 41 forms part of the system 40 and extends for the width of the housing 2, at juncture between the flat top surface 4 of forepart 3 and the sloped surface 6 of rearpart 5. An alarm vent 42 is formed to each side of the smoke-detection and alarm system 40 within the side walls of said housing 2.

Figure 2:
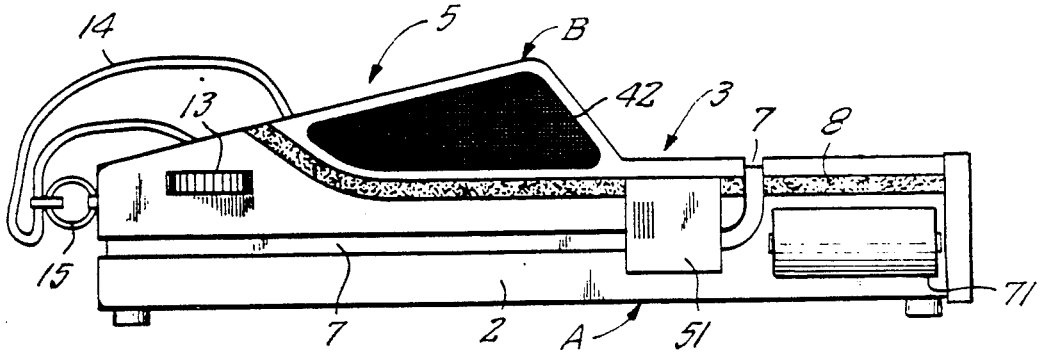
FIG. 2 is a side view in elevation, showing the opposite side of the device of FIG. 1.
Figure 3:
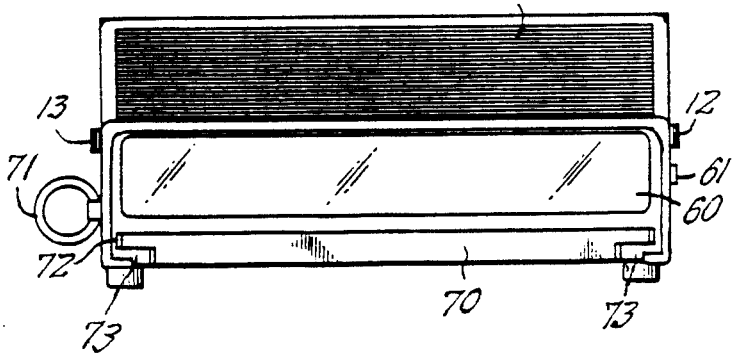
FIG. 3 is a front view in elevation of the device of FIG. 1.

Battery compartment 50 and lamp 60 are disposed within housing 2 below the flat top surface 4 of forepart 3, with battery compartment 50 disposed adjacent to smoke detection screen 41 at the rear edge of forepart 3 and lamp 60 disposed at the front edge of housing 2; in FIGS. 1 and 3, the lamp 60 is only identified at the rectangular lens thereof, and an elastomeric ring or collar member 62 provides a measure of lens protection; a groove 7 is formed in the flat top surface 4, extending across the width of the flat top surface 4 and down the side wall of housing 2. Groove 7 marks the division of battery compartment 50 and lamp 60. As best seen in FIG. 2 battery compartment 50 includes a door 51 which is releasably attached to a side wall of housing 2, thereby permitting insertion of batteries for operation of the device 1. The high-intensity lamp 60 is rectangularly shaped and projects to the front of the device 1. Lamp 60 is electronically interconnected with the smoke-detection and alarm system 40 so that lamp 60 will automatically light when the system 40 is activated. Lamp 60 can alternatively be operated manually by operation of lamp switch 61 which is located in a side wall of housing 2 adjacent to battery compartment 50. Luminous reflective strips 8 are disposed along the side walls of housing 2 to facilitate identification of the device in a dark or smoke-filled room. A strap handle 14 of such construction will facilitate rescue of a victim who has lost consciousness or become disoriented during an emergency.

Pencil holder 71 is integrally constructed in a side wall of the housing 2 at the front edge of the forepart 3 of housing 2. This holder 71 provides storage means for a pen or pencil (not shown) to be used in conjunction with writing table 70. Referring to FIG. 3, writing table 70 can be seen to extend the width of housing 2 and to be retractably engaged to opposed table-guide slots 72 formed at the front underside of the body of housing 2. Table 10 will be understood to ride bearing walls 73 which extend the length of housing 2. Table 70 is held in place in its closed position as by frictionally interfering engagement to walls 73 and to the top portion of slots 72, when in retracted position within the body of housing 2. Protective pads or feet 74 are shown on the undersides of walls 73, for cushioned four-corner support of the entire device 1.

Figure 4:
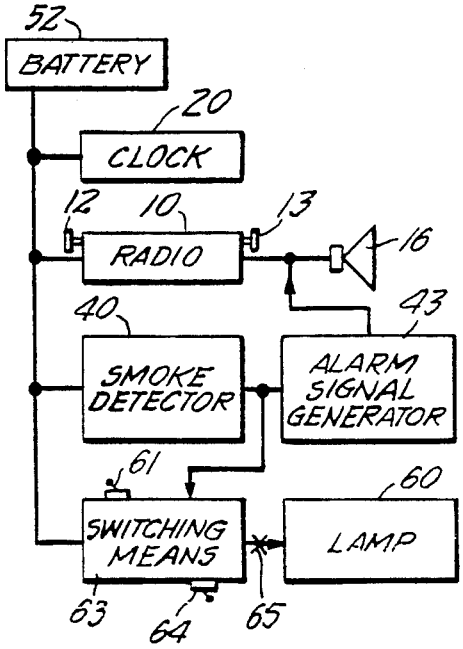
FIG. 4 is an electrical block diagram, schematically showing components and connections within the device of FIG. 1.

In FIG. 4, a battery 52, removably accessible via door panel 51, is shown connected to supply all electrical components within housing 2, namely, clock 20, radio 10, smoke detector 40 and switching means 64 for lamp 60. The control means 12, 13 for radio 10 are shown at opposite longitudinal ends thereof, and radio output is via a speaker 16, readily audible via side vents 42. Smoke detected at 40 produces an output signal to an alarmsignal generator 43, which in turn supplies alarm drive of the speaker 16; smoke detected at 40 also produces an output signal to the lamp-switching means 64, whereby a smoke-alarm condition is automatically accompanied by lamp lighting. Switch 61 is shown as part of the switching means 63, for selective manual operation of lamp 60, and another on-off switch 64 forming part of switching means 63 will be understood to provide selective conditioning of lamp lighting, in a first selected position as steady illumination, and in a second selected position as intermittent (i.e., pulsing) illumination.

Preferably, the housing 2 comprises two separate housing parts A, B, which on assembly to each other define the groove 7; these parts A, B, are suitably injection-molded plastic parts, as of high-impact styrene, ABS, or the like. The lower part A provides the base frame, containing components of lamp 60, the retractable table 70 and its elongate guide means 72, 73. The upper part B is internally accessible for release of its latch engagement to lower part A, upon removal of the battery access panel 51. Once removed, and with upper part B inverted, all of the described remaining components, being internally mounted, namely radio 10, its speaker 17, clock 20, compass 30, the smoke detector 40 and its alarm-signal generator 43, and battery 52 are conveniently and readily accessible for servicing, repair or replacement, when necessary. It is, of course, to be understood that, upon assembly of parts A and B to each other, separable wiping electrical contacts (suggested at 65) complete the described lamp connections of FIG. 4. And the radio antenna may either be contained within the housing 2, or it may be formed with the material of strap 14 and conductively connected to radio components within housing 2, via the strap fitting 15.

What is claimed is:

1. A portable personal-security device self-contained within a housing, comprising a smoke-detector producing an electric-signal output in response to a predetermined threshold of ambient smoke, a radio including a loudspeaker, a digital-time clock, a compass, a high-intensity lamp, a retractable writing table disposed in a manner permitting said lamp to illuminate its surface, said electric-signal output being connected to sound an audible alarm via said loudspeaker and concurrently to operate said lamp, and means within said housing for removable accommodating a battery to provide a source of power for said smoke detector, said clock, said radio, and said lamp.

2. A personal security device as described in claim 1 including a strap handle attached to said housing.

3. A personal security device as described in claim 2 wherein said strap handle is constructed of fire-resistant material.

4. A personal-security device as described in claim 1, further comprising an integrally constructed device for removably holding a writing instrument along one side of said housing.

5. A personal-security device self-contained within a portable housing, comprising a smoke detector producing an electric-signal output in response to a predetermined threshold of ambient smoke, a digital-time clock, a compass, a radio including a loudspeaker, a retractable writing table and a lamp positioned to illuminate said table, said electric signal output being connected to sound an audible alarm via said loudspeaker and concurrently to operate said lamp.

6. The device of claim 5, in which selectively operable switching means associated with said lamp enables selective operation of said lamp on a steady state or on an intermittent basis in response to said electric-signal output.

7. The device of claim 5, wherein said housing comprises separable upper and said lower halves, said lamp and writing table being mounted to said lower half, and said clock, said compass, said radio and said smoke detector being mounted within said upper half.

8. The device of claim 7, wherein a battery is also carried within said upper half and wherein wiping electrically conductive contacts are separable engaged to supply power to said lamp upon assembly of said upper and lower halves, whereby to render said lamp operable when said halves are in assembled relation.

9. The device of claim 8, wherein a removable panel of said upper half provides access to check and/or replace said battery, without separating said halves.

10. The device of claim 9, wherein latch means for selective release retention of said halves from each other is accessible via removal of the battery panel of said upper half.

* * * * *